US007106268B1

(12) United States Patent
Angelucci

(10) Patent No.: US 7,106,268 B1
(45) Date of Patent: Sep. 12, 2006

(54) ANTENNA ARRAY

(75) Inventor: Marc T. Angelucci, Cherry Hill, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/042,606

(22) Filed: Jan. 25, 2005

Related U.S. Application Data

(63) Continuation-in-part of application No. 10/290,733, filed on Nov. 7, 2002, now Pat. No. 6,891,511.

(51) Int. Cl.
*H01Q 21/26* (2006.01)

(52) U.S. Cl. ..... 343/797; 343/770

(58) Field of Classification Search ..... 343/700 MS, 343/797, 770, 795
See application file for complete search history.

(56) References Cited

U.S. PATENT DOCUMENTS

| | | | | |
|---|---|---|---|---|
| 5,309,165 | A * | 5/1994 | Segal et al. | 343/770 |
| 5,786,792 | A * | 7/1998 | Bellus et al. | 343/770 |
| 6,133,888 | A * | 10/2000 | Mohuchy | 343/770 |
| 6,359,596 | B1 * | 3/2002 | Claiborne | 343/795 |
| 6,552,691 | B1 * | 4/2003 | Mohuchy et al. | 343/770 |

* cited by examiner

*Primary Examiner*—Hoang V. Nguyen
(74) *Attorney, Agent, or Firm*—Duane Morris, LLP

(57) ABSTRACT

TEM horn array apertures are disclosed, comprises a plurality of stamped sheet segments interconnected to form an "egg crate" like array. Each stamped sheet comprises a plurality of TEM horn antennas with a series of cooperating slots, enabling the sheets to be assembled into an "egg crate" design that allows quick and inexpensive building of a TEM horn antenna array. Moreover, the stamped sheet segments are structurally and dimensionally stable, and thus the assembled array may be connected to a guide plane without the need for additional aligning or structural elements. A method of assembling the array is also disclosed.

2 Claims, 9 Drawing Sheets

ANTENNA ARRAY

CROSS-REFERENCE TO RELATED APPLICATION

This application is a continuation-in-part of U.S. nonprovisional patent application Ser. No. 10/290,733, filed Nov. 7, 2002, now U.S. Pat. No. 6,891,511 By Marc T. Angelucci, titled "Method of Fabricating a Radar Array," the entire contents of which is incorporated herein by reference.

FIELD OF THE INVENTION

The present invention relates to the field of microwave antenna arrays.

BACKGROUND

As the frequency of operation of radar antennas increases, the spacing between the radiating elements that make up the aperture becomes smaller. For example, the spacing may be less than 1.0 cm (0.400") center-to-center at 16 GHz (Ku band). In addition, effective phased array radars can have 10,000 or more radiating elements. The radiating elements in these assemblies have critical alignment requirements. They also require isolation between adjacent radiating elements and excellent grounding.

Previous designs require manufacturing individual horn elements, each of which must be produced by a complicated machining process. The individual horn elements must then be mechanically interconnected to adjacent elements to assemble a horn array of a desired size. Such a process is complex both in the machining of the individual horn elements, as well as in the alignment and interconnection of adjacent elements. Thus, there is a need for an improved arrangement and assembly process for fabricating a horn array that reduces or eliminates complex machining steps, and which also simplifies the array assembly process. An improved array structure and method of making the array is thus disclosed.

SUMMARY OF THE INVENTION

An antenna array is disclosed, comprising a first strip of first horn segments, the first horn segments each including a radiating portion and a ground plane connection portion. A second strip is also provided having a plurality of second horn segments, the second horn segments each including a radiating portion and a ground plane connection portion. The first and second strips further can have cooperating slots disposed between the radiating and ground plane connection portions of each horn segment which are configured to interlock to allow the first and second strips to be assembled into a dimensionally stable lattice having an upper radiating end and a lower ground plane connecting end. A connector is associated with each horn segment of the first and second strips for connecting the horns to a transmit/receive distribution network. The lower ground plane connecting end of the lattice is configured to engage a ground plane for direct fixation thereto.

In one embodiment, when the first and second strips are interlocked, the plurality of first horn segments are disposed substantially perpendicular to the plurality of second horn segments. The first and second strips can be secured together by epoxy.

The connectors can be integrally formed with an associated fin line feed element. The plurality of first and second sheets are stamped or machined to form the associated plurality of horn segments. The plurality of first and second sheets can be made of aluminum or a metallized plastic. The metallized plastic sheets can be formed by a suitable molding or injection molding process. Alternatively, the plurality of first and second sheets can be made of copper or a chromium-copper alloy.

An antenna array is disclosed, comprising a plurality of first and second horn strips, where each horn strips can have a plurality of horn segments, and each of the horn segments can comprise a radiating portion and a ground plane connection portion. The first and second horn strips each can comprise cooperating vertically-disposed slots configured to allow pairs of first and second strips to lock together into a dimensionally stable lattice. A plurality of connectors can be associated with the horn segments of the plurality of first and second strips for connecting each horn segment to a transmit/receive distribution network. The lattice can have a ground plane connecting end can be configured to engage a ground plane for direct fixation thereto.

The plurality of first and second horn strips can be stamped or machined to form the associated plurality of horn segments. Also, the plurality of horn segments of each first strip in the lattice can be disposed substantially perpendicular to the plurality of second horn segments of each second strip in the lattice. The plurality of first and second strips can be secured together by epoxy. The connectors can be coaxial connectors. The plurality of first and second horn strips can comprise aluminum or a metallized plastic, or alternatively they can comprise copper or chromium copper alloy.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts, and further wherein.

DETAILED DESCRIPTION

Figure 1:
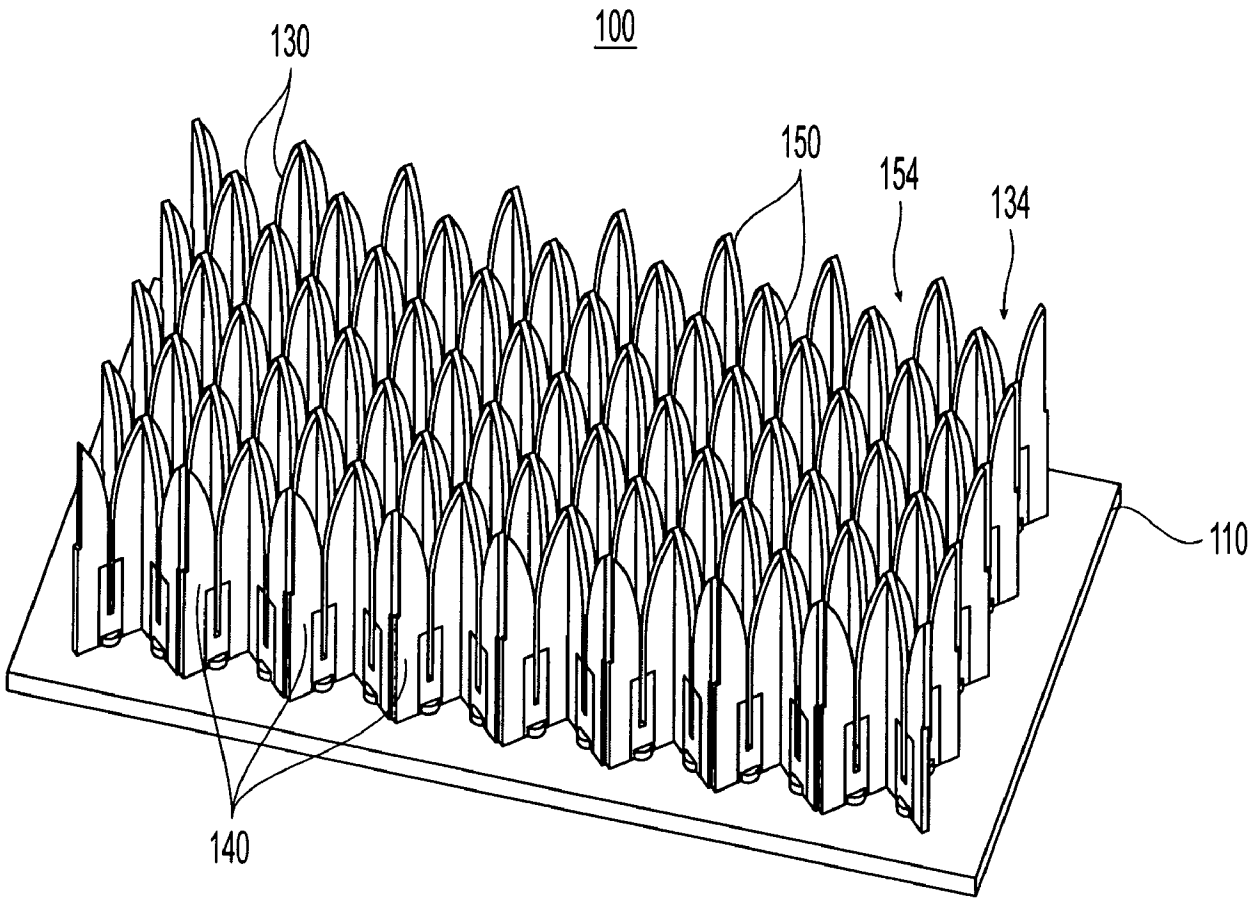
FIG. 1 is an isometric view of an exemplary microwave antenna array 100.

In the accompanying drawings, like items are indicated by like reference numerals.

This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 is an isometric view of an exemplary microwave antenna array assembly 100. Array 100 may be a complete aperture or a fractional portion of a larger array suitable for use in a wide-band phased array radar system. In the exemplary array 100, radiating elements are assembled vertically above a metal ground plane in a lattice of orthogonal pairs. The structure visually resembles an "egg crate" as shown in FIG. 1. This representative section of a large phased array aperture has 128 horns 134, 154 on a metal ground plane 110.

The array assembly 100 comprises a ground plane 110 and a plurality of multi-element strips 130, 150. The ground plane 110 may be a plate of suitable metal, such as aluminum or copper. The multi-element strips include at least one first (lower) strip 130 having a plurality of horns 134 (FIG. 2) and a first plurality of slots 138. The multi-element strips include at least one second strip 150 (FIG. 3) mounted on the at least one first strip 130. The second strip 150 has a plurality of horns 154 and a second plurality of slots 157 that mate with the slots 138 of the at least one first strip 130. In the example of FIG. 1, there are a plurality of lower multi-element strips 130 and a plurality of upper multi-element strips 150 arranged in a lattice array.

Preferably, the strips 130, 150 are made of metal, such as aluminum, or metallized plastic to minimize the overall weight of the assembled array. Metallized plastic strips can be formed using a suitable molding or injection molding process. In such cases, conductive adhesive (e.g., conductive epoxy) may be used to form secure physical and electrical connections among the strips. Importantly, however, it should be possible to manufacture the strips using stringent tolerances so that they can simply be fit together without the need for adhesives.

Alternatively, the strips 130, 150 can be made of a solderable material (e.g., copper or a chromium-copper alloy), or have a solder or indium plating thereon. The strips in this example are made of chromium-copper (C18200 alloy). Solder plating on all surfaces provides solder volume and also protects the strips from the environment. When the multi-element strips 130, 150 are assembled, the solder can be reflowed to form secure physical and electrical connections among the strips. The solder may be tin-lead solder, for example. Other solder compositions or indium may be used. In other embodiments, solder can be applied in situ after assembly of the strips 130, 150 onto the ground plane 110.

The strips 130, 150 are preferably individually stamped or machined from unitary pieces of material (again, aluminum, metallized plastic, etc.). The advantage of providing stamped or machined metal strips is that they can be fabricated to precise dimensions with tight tolerances that will remain stable when subject to the long term operational environment. Such dimensional stability ensures that when the strips 130, 150 are assembled together, the horns 134, 154 will be precisely positioned with respect to each other, and that this precise positioning will be maintained throughout operation. Thus, no adhesives should be required to maintain this positioning, nor should additional alignment hardware (e.g. positioning clips) be required.

The strips 130, 150 are self-aligning to ensure that, when assembled (as described below) assembly, the adjacent horns 134, 154 are accurately positioned vertically, laterally, and rotationally with respect to each other. The rotational alignment of the strips 130, 150 is provided by the multiplicity of interconnections between the slots 138, 157 that must be aligned in order for the various strips 130, 150 to lie straight.

Figure 3:
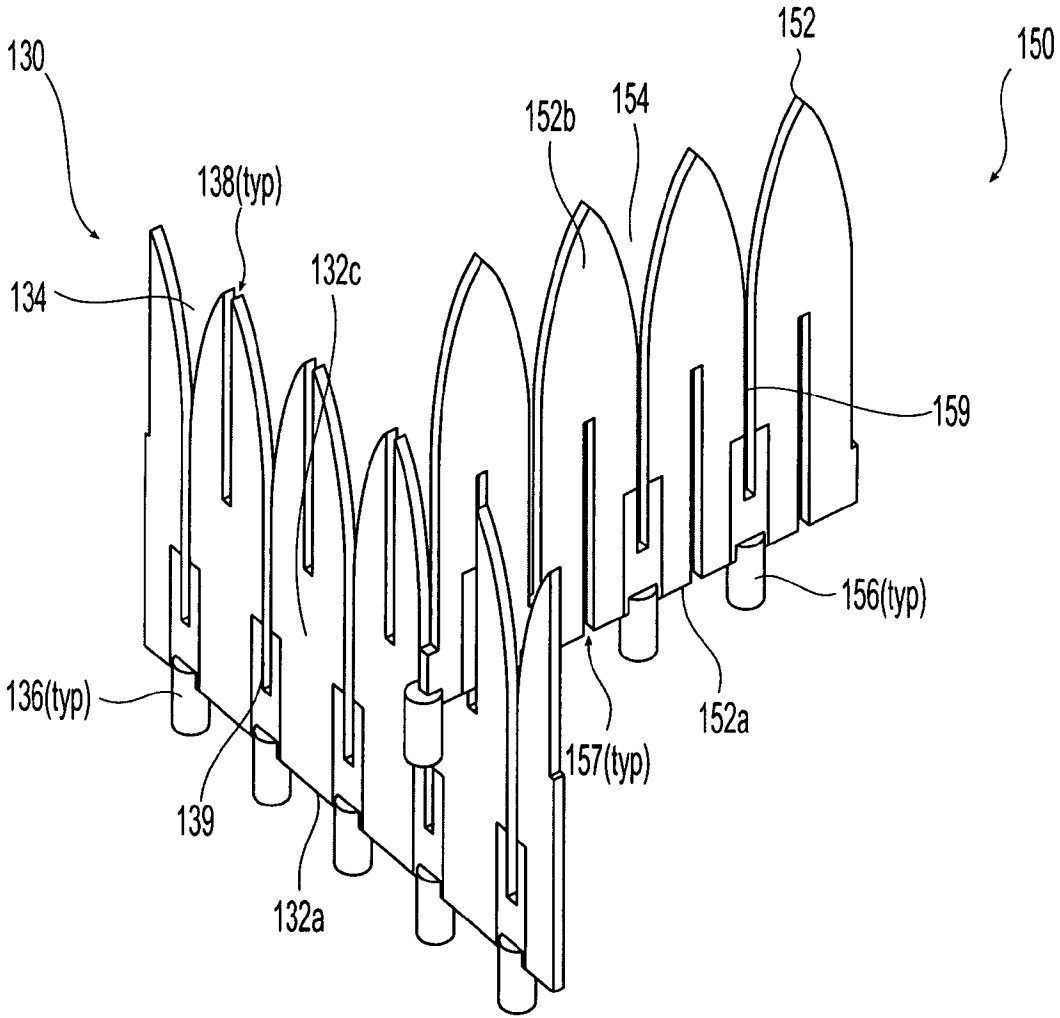
FIG. 3 is an isometric view showing the step of mounting an upper multi-element strip (of the type shown in FIG. 1) on the strip of FIG. 2.
Figure 4:
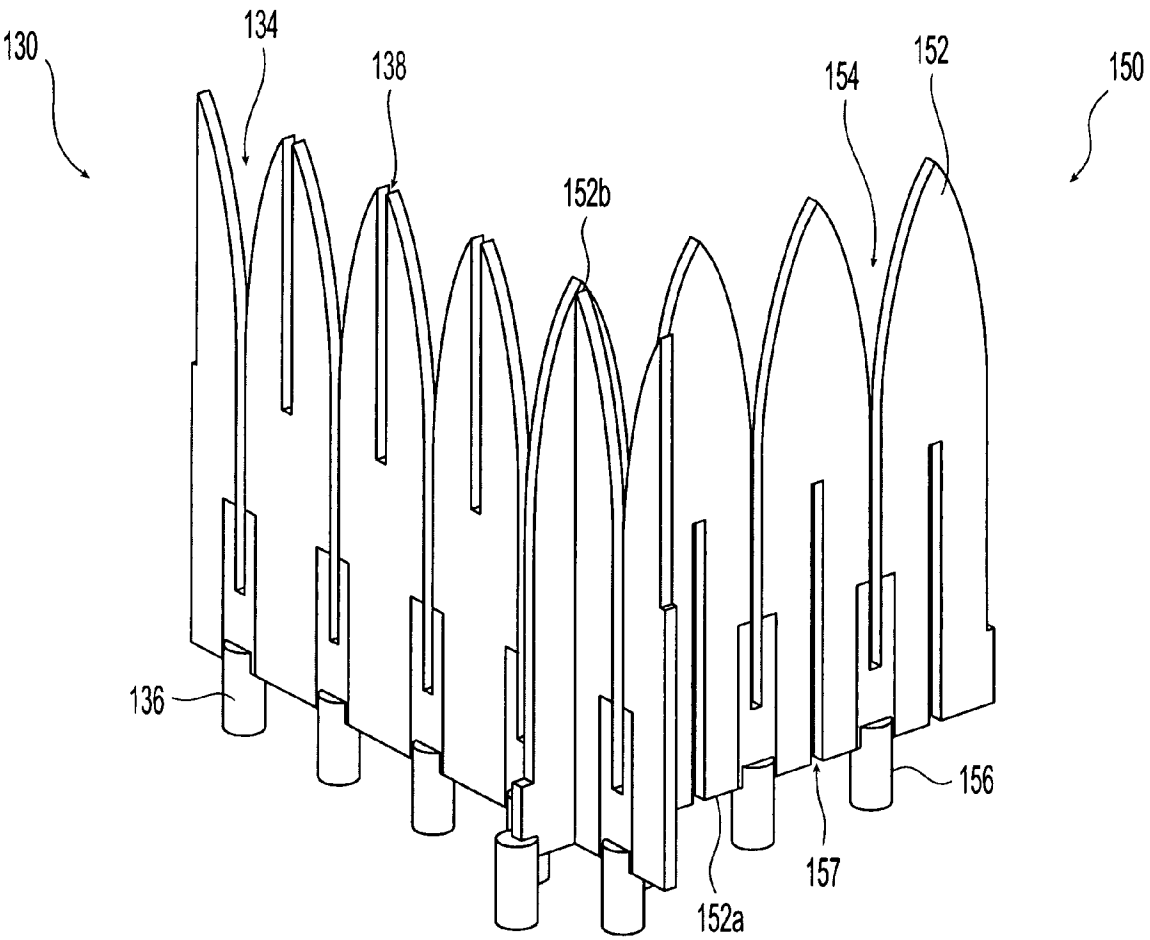
FIG. 4 is an isometric view of the partial assembly of FIG. 3 after both lower and upper multi-element strips are in position.

FIGS. 3 and 4 show a method for assembling a subassembly having one lower multi-element strip 130 and one upper multi-element strip 150.

As shown in FIG. 3, the strip 130 has a plurality of identical horns 134. The horns 134 can be formed by stamping or machining as previously described. Each horn 134 has a connector 136 for connecting the element to the transmit/receive distribution network (not shown). An exemplary connector is a Gilbert SK-1896-2 edge-launch male connector manufactured by the Corning Gilbert Corporation of Glendale, Ariz., which can be used to connect a fin line feed 1136 (FIG. 2*a*) directly to a coaxial cable. As shown in FIG. 2*a*, The fin line feed 1136 can be a microstrip circuit 1139 bonded to a carrier 1138. The microstrip circuit 1139 can comprise a ceramic (e.g. alumina) or duroid substrate 1139*a* having a thin layer of etched copper 1139*b* disposed thereon. The fin line feed 1136 with connector 136 can be attached to the associated horn 134 using any appropriate technique known in the art, such as brazing, epoxy, etc. The carrier 1138 may have a vertical slot 1137 configured to correspond to a slotted portion 135 of the associated horn 134. The microstrip circuit 1139 itself will overlie the vertical slot 1137 and part of the slotted portion 135 of the associated multi-element strip 130.

The lower multi-element strip 130 has a plurality of slots 138 with a respective slot between each pair of adjacent horns 134. Slots 138 are located at an edge 132 distal from the ground plane 110, to receive bridge portions 152*b* of the upper strips 150. In alternative embodiments (not shown) having more than two circuit boards intersecting at a single point, the slot 138 may receive connecting portions of two or more strips (which may be accomplished by providing a longer slot 138, or shorter connecting portions on the upper strip).

The bottom edge 132*a* of strip 130 abuts the ground plate 110 to locate the strip 130 for properly seating the connector 136 to mate with the distribution network (not shown).

FIG. 4 shows an assembly step in which the upper multi-element strip 150 is being moved into position with the lower multi-element strip 130. The upper multi-element strip 150 is similar to the lower multi-element strip, with significant differences explained below. Otherwise, like features of strip 150 have the reference numerals of corresponding features of strip 130, increased by 20. These like features include horns 154, connector 156, and fin line feeds.

In strips 150, the slot 157, extending from the bottom edge 152*a* proximate to the ground plane 110 is longer than the slot 138 of the lower strip 130 by an amount that is approximately the height of the connecting section 132*c* of the lower strip. The bridge (attachment portion) 152*b* is at or adjacent to the distal (top) edge 152 of the strip 150 from the ground plane 110. There is no need for a second slot above the bridge 152*b*, and in preferred embodiments, there is none (although alternative embodiments—not shown—may optionally include a second slot, for example, to accommodate one or more additional strips). The bridge 152*b* is received by the slot 138 of the strip 130.

Slots 138 and 157 intersect like a pair of intersecting combs. When the connecting strip 150 is in its final position, the bridge section 152*b* may optionally abut the top of connecting section 132*c*, or a small space may be allowed between them. When assembled in this manner, the multi-element strips 130, 150 including the horns 134, 154 are self-aligned in all axes to pre-established reference locations on the ground plane 110. These pre-established reference locations can, for example, consist of slots or holes in the ground plane 110 into which corresponding tabs or dowels on the strips 130, 150 can fit. In one embodiment, the tabs or dowels can be configured to snap into the corresponding reference locations, further facilitating assembly of the array, by eliminating the need for additional hardware or soldering steps to fix the strips to the ground plane. Appropriate ratchet surfaces or other snap-in features can be used for this purpose. Alternatively, the corresponding mechanical engagement features of the strips and ground plane can be sized and toleranced to be press-fit together. As will be appreciated, other similar connection schemes can be used to engage the strips with the ground plane.

Figure 7:
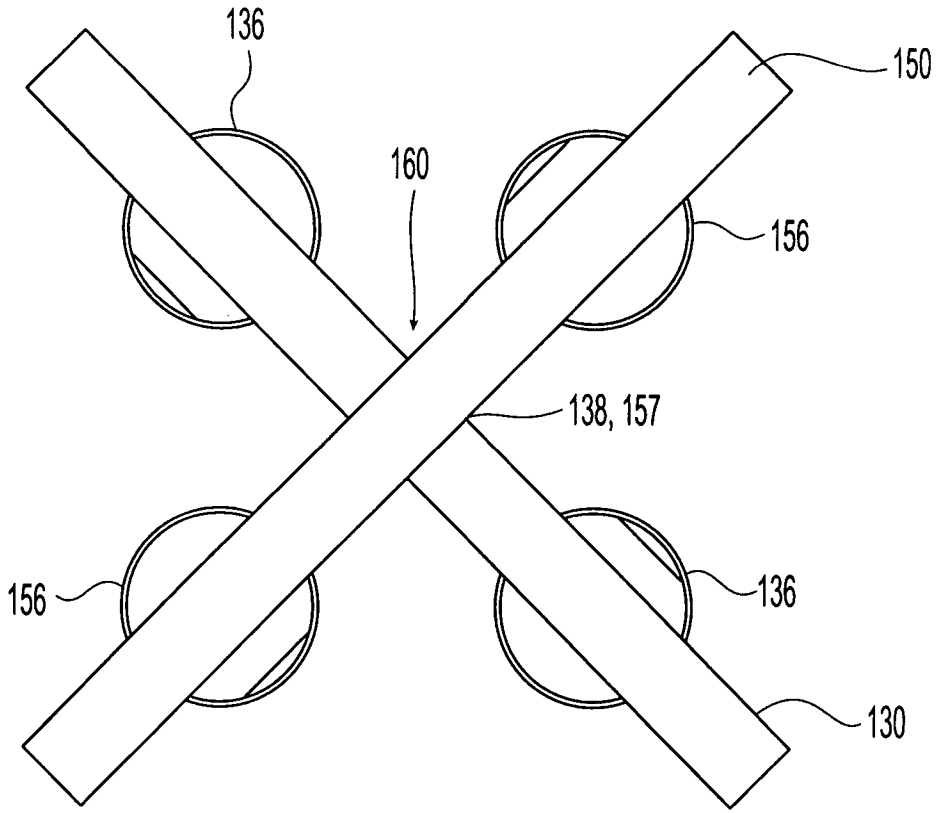
FIG. 7 is a cross sectional view of the intersection of two multi-element strips, taken along section line 11—11 of FIG. 4.

FIG. 4 shows the lower strip 130 and upper strip 150 in the assembled configuration. In the example, the horns 134 and 154 are positioned at the same height, with the connectors 136 and 156 also at the same height. The metal-to-metal contact between strips 130, 150 provides isolation and prevents leakage between adjacent horns 134, 156. A cross-sectional plan view of a connection "node" 160 between strips 130, 150 is shown in FIG. 7.

Figure 2:
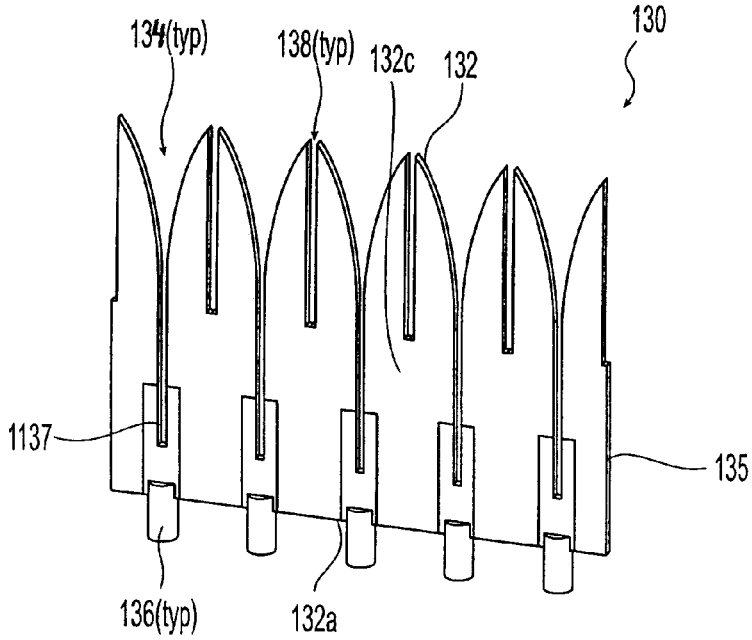
FIG. 2 is a partial assembly view showing a multi-element strip (of the type shown in FIG. 1)
Figure 2A:
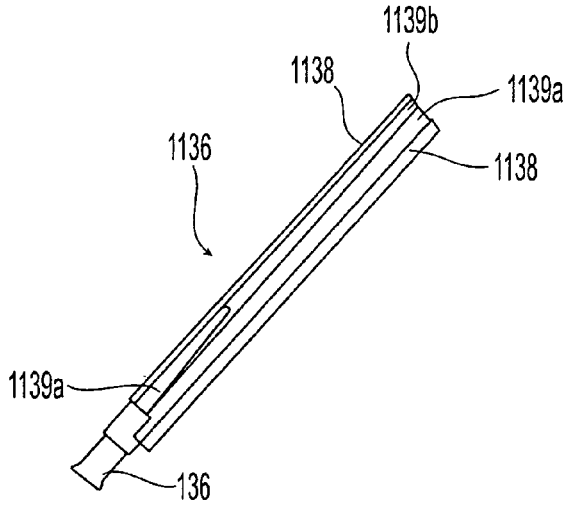
FIG. 2*a* is a perspective view of a fin line and connector assembly of the multi-element strip of FIG. 1.

Although FIGS. 2–4 show a structure and method for assembling two perpendicular multi-element strips into an array of square cells, other embodiments may have strips that are not orthogonally, e.g., to form a lattice of polygonal cells (e.g., diamond or hexagonal shaped cells).

Furthermore, although the arrangement of FIGS. 2–4 have only two strips intersecting at each junction or "node" 160 (FIG. 7), in other embodiments, three or more multi-element strips can intersect at a single junction.

Figure 5:
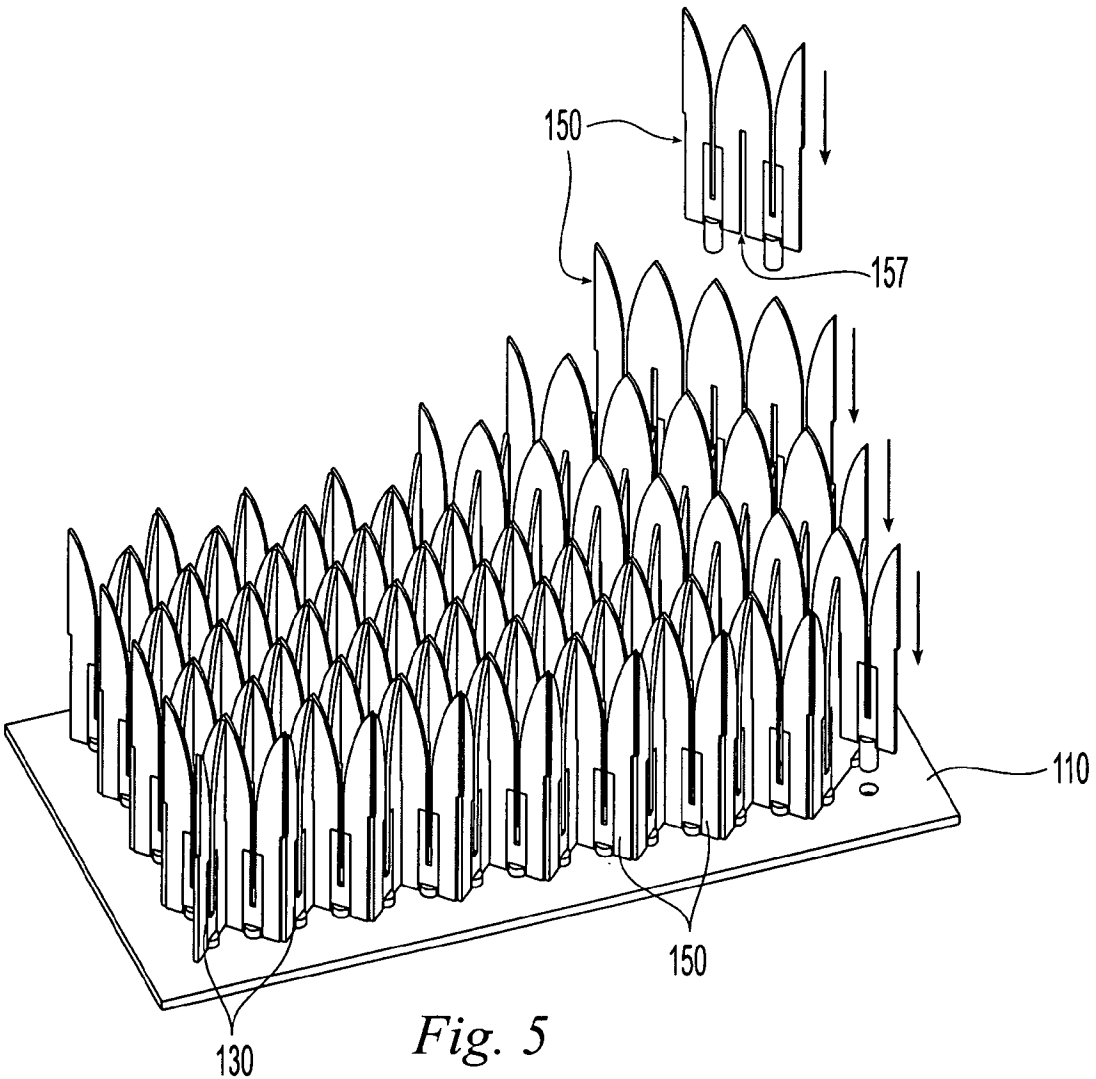
FIG. 5 shows the insertion of a plurality of upper multi-element strips into a plurality of lower multi-element strips.
Figure 6:
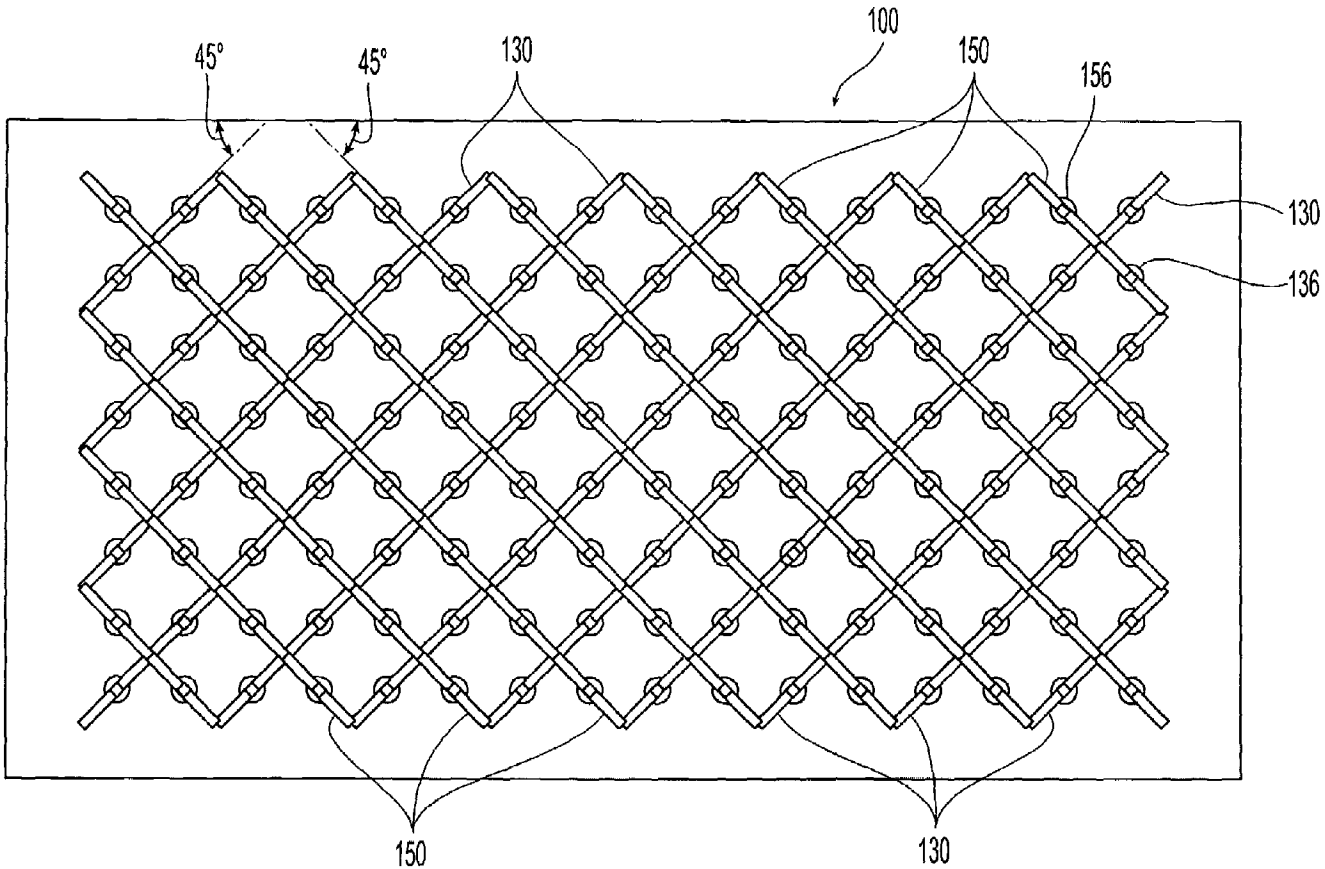
FIG. 6 is a top plan view of a fractional array assembly.

FIG. 4 shows the assembly of an individual joint, however, the design of the strips 130, 150 permits an entire horn array to be preassembled in one process. This may be accomplished by assembling multiple multi-element strips 130, 150 containing a plurality of horns, to create a lattice as shown in FIG. 5, and then placing the lattice on the ground plane 110 as shown in FIGS. 5–6. As previously noted, the ground plane 110 can have a plurality of pre-established reference locations (e.g., slots, recesses or other features) that correspond to specific portions of strips 130, 150 and which guarantee accurate positioning of the strips (and thus the array) on the ground plane 110. Alternatively, when using strips configured to be soldered together, or to be soldered to the ground plane 110, the array of horns 134, 154 can be joined together and the solder in the assembly 100 can then be reflowed en masse, thus connecting the strips 130, 150 to each other and to the ground plane in one reflow step.

FIGS. 5 and 6 show an exemplary method of assembling the array shown in FIG. 1. Successive rows of strips 130, 150 are interlaced so that their slots 138, 157 are oriented at ±45 degrees from the vertical edge of the ground plane 110, and ±45 degrees from the horizontal edge of the ground plane. As a result, as best seen in FIG. 6, the horns are oriented at ±45 degree angles from horizontal. In FIG. 6, four different strip lengths (corresponding to two, four, six and eight horns, respectively) are sufficient to form a 64 element array 100 having a rectangular form factor. The number of different strip lengths used for any given array 100 depends on the lesser of the number of rows and the number of columns of horns. An array 200 having a desired number of horns can be formed using a plurality of such arrays 100.

Figure 8:
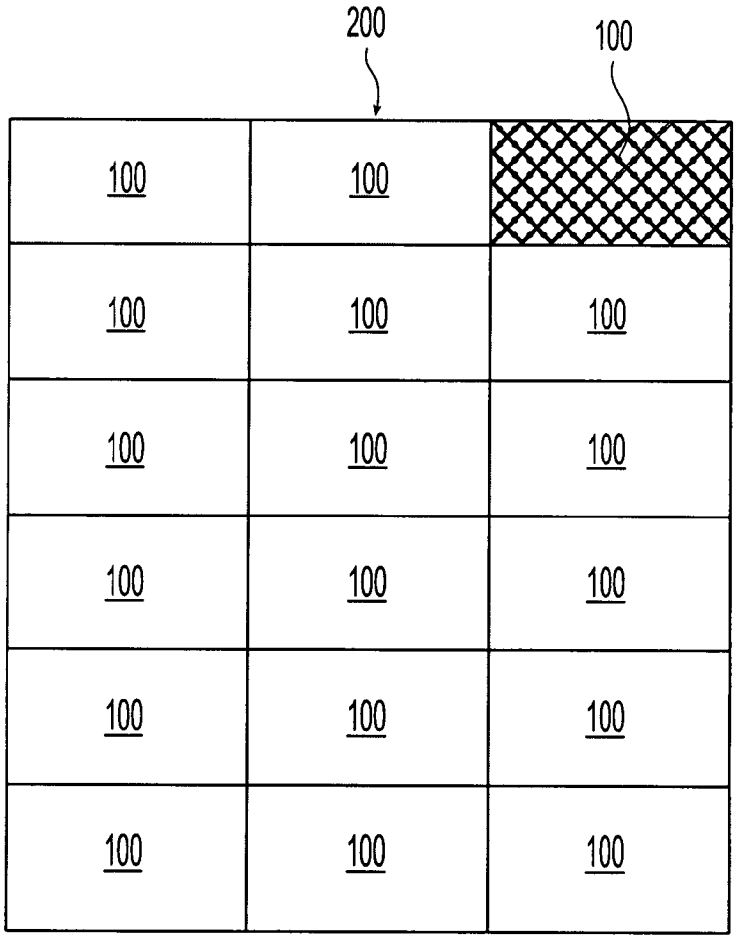
FIG. 8 shows an array comprising a plurality of array assemblies of the type shown in FIG. 6 assembled to form a larger array.

Multiple individual arrays can also be assembled together to form a larger array. For example, as shown in FIG. 8, an 1152 horn array 200 can be formed of 18 individual array sections 100. Due to the tight fit between the individual strips 130, 150, and the fact that the strips are made of metal, the arrays 100 are expected to be sufficiently rigid that they will not need to be physically connected to one another. The junctions between the fractional arrays can, however, be joined using epoxy, or solder.

Referring again to FIG. 5, the first strips 130 may have respectively different lengths, so as to provide the array 100 with any desired shape (e.g., rectangular, square or approximately octagonal or circular), with a respective one of the plurality of clips at each corner of each polygonal cell.

FIG. 5 shows a plurality of second (upper) strips 150 being inserted on the first strips 130, with the strips 150 parallel to each other, and normal to the first strips 130. The intersecting lower and upper strips 130, 150 form an array of square cells, with respective horns 134, 154 within each of the cells. The second (upper) strips 150 have a plurality of horns 154 and a first plurality of slots 157. As shown in FIG. 5, the second strips 150 may also have respectively different lengths, so as to provide the array 100 with any desired shape (e.g., rectangular, square or approximately octagonal or circular).

The advantage of the present design is that a large array can be manufactured from sheets of metal (or metallized plastic) without the need for constructing fractional array elements which themselves must be fit together to make the large array. In one example, using aluminum, it is expected that individual strips could be manufactured, each having 100 horn elements 134, 154, and that a large array could be constructed from these individual strips.

Although the invention is expected to be advantageous for forming large arrays without the need for smaller fractional arrays, such smaller arrays can still be made. Thus, FIG. 6 shows and exemplary assembled array 100.

FIG. 7 is an enlarged detail of FIG. 1, showing a pair of adjacent cells in detail. A conductive joint or "node" 160 is formed along each edge of the slots 138, 157 of the first and second multi-element strips 130, 150. These "nodes" 160 consist of the metal-to-metal interface between the slots 138, 157 in the upper and lower strips 130, 150. The tight tolerances used to form the strips 130, 150, and the fact that the metal or metalized plastic construction of the strips is expected to hold these tolerances for an extended term, even under shock conditions, result in structural "nodes" in the array 100 which make the "egg crate" structure of the array very rigid.

Figure 9:
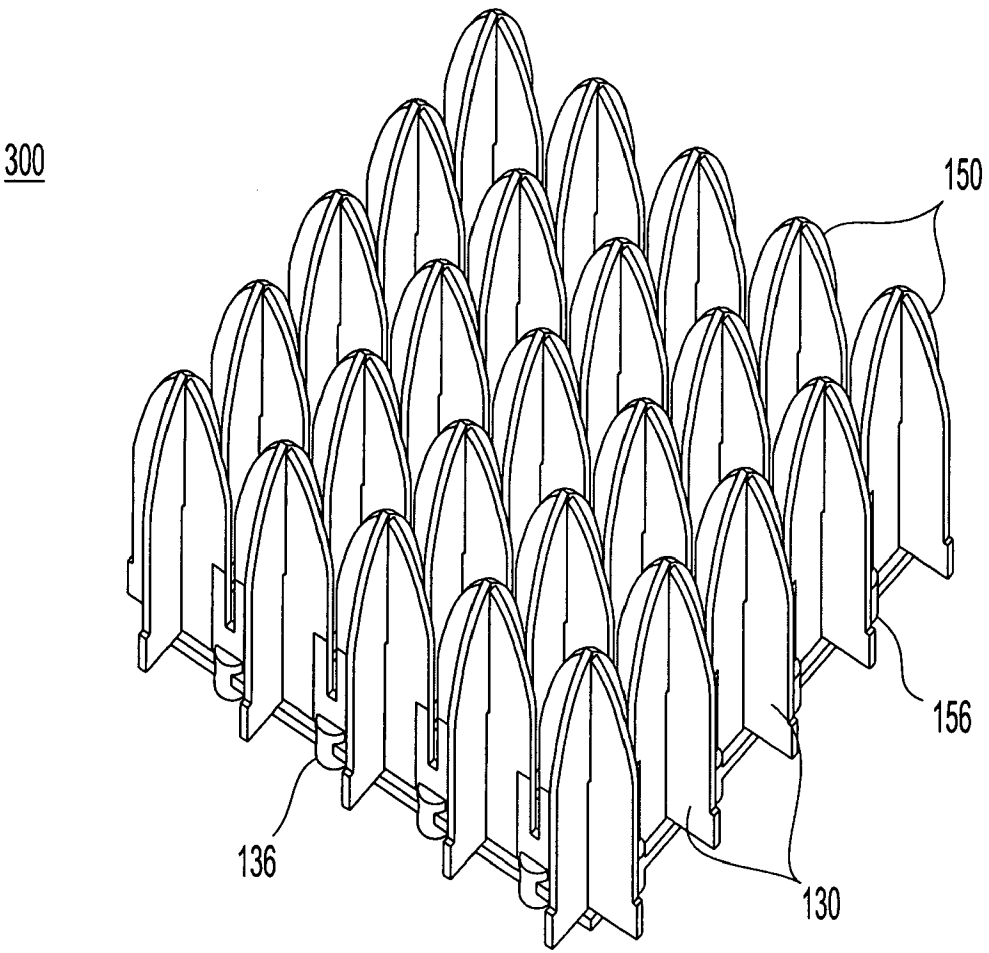
FIG. 9 is an isometric view of a variation of the fractional array shown in FIG. 1.

FIG. 9 shows another arrangement of the lower strips 130 and upper strips 150. Although the embodiment shown in FIGS. 1–7 has a triangular lattice pattern, other configurations are contemplated. For example, in alternative embodiments such as that of FIG. 9, the rows and columns of strips 130, 150 are all aligned in a plain rectangular grid 300, which may be square. In this configuration, each lower multi-element strip 130 has the same first number of horns, and each upper multi-element strip 150 has the same second number of horns, where the first and second numbers may be the same as, or different from, each other.

In the examples of FIGS. 1–7 and 9, each collinear arrangement of horns is provided using a single multi-element strip 130 or 150. In other embodiments (not shown), a relatively long collinear arrangement of horns may be provided using two or more aligned multi-element strips, where the abutting ends of each strip comprise a respective half of the slots 138 (for lower strip 130) or 157 (for upper strip 150). This technique may be used to reduce the number of different multi-element strip sizes in an array having a large number of rows and a large number of columns of horns.

A method for fabricating an array 100 will now be described, with reference to the foregoing figures.

First, a plurality of multi-element strips 130, 150 are stamped or machined from individual pieces of selected material (e.g. aluminum, metallized plastic). The fin line feeds 1136 are then constructed by bonding a microstrip 1139 to a carrier element 1138 using, for example, a thermosetting adhesive, and then attaching a coaxial connector 136, 156 to the microstrip 1139. The fin line feeds 1136 can then be bonded, for example, using a thermosetting adhesive, to each radiating element 134, 154 of the multi-element strips 130, 150.

For embodiments in which a solder material is used to connect the strips together, or to the ground plane 110, solder can be applied to the bottom edges of the multi-element strips 130, 150 and/or to the inside edges of the slots 138, 157. If solder is not used, then this step is skipped.

Gaskets (not shown) may then be inserted into each connector-receiving hole in the plate 110. The gaskets can be positioned so that, in the finished assembly, the gasket lies beneath the associated connector 136, 156. The gasket can provide EMI shielding, a weather seal for the marine environment, and a light pressure seal. The gasket may be, for example, a Cho-Seal 1298 corrosion resistant EMI gasket manufactured by Parker Chomerics of Woburn, Mass.

The upper strips 150 are then pressed into position on the corresponding lower strips 130 (FIGS. 3–5). For embodiments in which the strips are epoxied together, a suitable epoxy can be applied to the slot surfaces prior to pressing the strips together.

Once the strips 150, 130 have been assembled to create an array of the desired size, the connectors 136, 156 can be fit into the associated openings the ground plane 110. For the preferred embodiment in which pre-established reference locations (e.g. slots or holes) are provided on the ground plane 110 to engage corresponding features in the strips 130, 150, the assembled strips can be fit (e.g. snap-fit, press-fit, or the like) into the reference locations, thus aligning the array on the ground plane 110.

In one alternative embodiment, the connectors can be used to fix the strips to the ground plane. Standard hardware can be used for this purpose (e.g., screws and washers located on the bottom surface of the ground plane 110) and can be torqued to fix the connectors 136, 156 (and thus the strips 130, 150) to the plate 110.

In alternative embodiments employing solder connections between strips and/or between the strips and the ground plane 110, the solder can be reflowed to form the desired electrical and mechanical connection. In some embodiments, the entire array 100 can be placed in a reflow oven (not shown) for this purpose. In other embodiments, a local heating tool can be used to reflow the solder locally only at the boundaries. In some embodiments, a reflow tool (not shown) can be used to apply radiant heat at the desired location. An example of a reflow tool includes a plurality of heating elements, each including a cartridge heater at the center of a ceramic insulator. The insulators may have cutouts to direct the radiated heat. These heating elements may be configured in a one or two dimensional array.

Where soldered arrays are used for developing a larger array, the individual arrays 100 can be formed (i.e. soldered) independently. Alternatively, the strips 130, 150 for each individual array 100 can be connected together, and the individual arrays 100 positioned adjacent one another, followed by a mass reflow of the entire array. The interaction between the slotted multi-element plates 130, 150 facilitates the use of a reflow process that can assembly very large arrays of horns. A reflow process of this type is advantageous for high frequency-wide band radiating elements where a small lattice—for example <1.0 cm (<0.400") center to center at 16 GHz—limits the working space when using local soldering or epoxy attachments that require alignment tooling.

Some advantages of the attachment method described above are that the solid metal strips with slots eliminate the need for alignment tooling or alignment clips to position the horns vertically, laterally, or rotationally.

Furthermore, although the radiating elements 134, 154 have been illustrated as being elliptical in shape, other configurations are also possible. For example the radiating elements 134, 154 could have a stepped or corrugated configuration.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. An antenna array comprising:

a first strip of first horn segments, the first horn segments each comprising a radiating portion and a ground plane connection portion;

a second strip of second horn segments, the second horn segments each comprising a radiating portion and a ground plane connection portion;

the first and second strips further comprising cooperating slots disposed between the radiating and ground plane connection portions of each horn segment, the cooperating slots configured to interlock to allow assembly of the first and second sheets into a dimensionally stable lattice having an upper radiating end and a lower ground plane connecting end; and a plurality of connectors associated with the horn segments of the plurality of first and second sheets for connecting each horn segment to a transmit/receive distribution network;

wherein at least one of the first and second strips at the lower ground plane connecting end of the lattice comprises engaging tabs configured to engage corresponding recesses in the ground plane via a snap-fit or press-fit connection for direct fixation thereto.

2. An antenna array comprising:

a plurality of first and second horn strips, each of said horn strips having a plurality of horn segments, each of the horn segments comprising a radiating portion and a ground plane connection portion;

wherein the first and second horn strips each comprise cooperating vertically-disposed slots configured to allow pairs of first and second strips to lock together into a dimensionally stable lattice; and a plurality of connectors associated with the horn segments of the plurality of first and second strips for connecting each horn segment to a transmit/receive distribution network;

wherein the lattice has a ground plane connecting end configured to engage a ground plane for direct fixation thereto; and wherein at least one of the plurality of first and second horn strips comprises engaging tabs configured to engage corresponding recesses in the ground plane via a snap-fit or press-fit connection.

* * * * *